US011513458B2

(12) United States Patent
Kozuma

(10) Patent No.: US 11,513,458 B2
(45) Date of Patent: Nov. 29, 2022

(54) FIXING APPARATUS INCLUDING LUBRICANT GUIDING PORTION

(71) Applicant: Canon Kabushiki Kaisha, Tokyo (JP)

(72) Inventor: Takeshi Kozuma, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/352,788

(22) Filed: Jun. 21, 2021

(65) Prior Publication Data

US 2021/0405559 A1 Dec. 30, 2021

(30) Foreign Application Priority Data

Jun. 24, 2020 (JP) ..... JP2020-108333

(51) Int. Cl.
*G03G 15/20* (2006.01)
*G03G 15/16* (2006.01)

(52) U.S. Cl.
CPC ..... *G03G 15/2053* (2013.01); *G03G 15/2064* (2013.01); *G03G 15/1615* (2013.01); *G03G 2215/2032* (2013.01)

(58) Field of Classification Search
CPC ..... G03G 2215/00143; G03G 2215/00151; G03G 2215/00156; G03G 2215/0016; G03G 15/2025
See application file for complete search history.

(56) References Cited

U.S. PATENT DOCUMENTS

| | | | | |
|---|---|---|---|---|
| 7,392,006 | B2 | 6/2008 | Kameda et al. | |
| 2006/0245798 | A1* | 11/2006 | Nakayama | G03G 15/2053 399/329 |
| 2097/0059060 | | 3/2007 | Kameda et al. | |
| 2008/0317524 | A1* | 12/2008 | Takahashi | G03G 15/2035 399/329 |
| 2009/0035034 | A1* | 2/2009 | Nagase | G03G 15/2025 399/329 |
| 2018/0067432 | A1* | 3/2018 | Yamaguchi | G03G 15/2053 |
| 2018/0164722 | A1* | 6/2018 | Aoki | G03G 15/2017 |

FOREIGN PATENT DOCUMENTS

| | | |
|---|---|---|
| JP | 2007-079036 A | 3/2007 |
| JP | 2015-059964 A | 3/2015 |

* cited by examiner

*Primary Examiner* — Arlene Heredia
(74) *Attorney, Agent, or Firm* — Venable LLP

(57) ABSTRACT

A fixing apparatus includes a rotatable belt, a rotatable pressurizing member, a steering roller, a contact portion, a detected portion, a sensor, and a guiding portion. The contact portion comes into contact with an end portion, in the width direction, of the belt. A position of the detected portion is changed on a basis of a position of the contact portion. The sensor detects the position of the detected portion. An inclination of the steering roller is controlled on a basis of a detection result of the sensor. The guiding portion is provided by connecting with the contact portion. The lubricant is guided from the contact portion to the guiding portion. The guiding portion is provided in a region below the contact portion in a vertical direction, inside of the belt, and overlapped with the belt in the width direction.

9 Claims, 7 Drawing Sheets

FIXING APPARATUS INCLUDING LUBRICANT GUIDING PORTION

BACKGROUND OF THE INVENTION

Field of the Invention

The present invention relates to a fixing apparatus used in an image forming apparatus of an electrophotographic system, an electrostatic recording system, or the like.

Description of the Related Art

Conventionally, as a fixing apparatus used in an image forming apparatus of an electrophotographic system, a fixing apparatus including a fixing roller and a pressurizing belt having an endless shape is known as disclosed in Japanese Patent Laid-Open No. 2007-79036. In this fixing apparatus, the fixing roller is heated and rotated, and the pressurizing belt is in contact with the fixing roller and rotated by the rotation of the fixing roller. Further, in a nip portion where the fixing roller and the pressurizing belt are in contact with each other, a recording material bearing an unfixed toner image is nipped and conveyed, and simultaneously the toner image is heated and pressurized to be fixed to the recording material. In addition, to bring the fixing roller and the pressurizing belt into pressure contact with each other in the nip portion, a nip forming member that presses the pressurizing belt against the fixing roller in the nip portion is provided slidably on the inner peripheral surface of the pressurizing belt. To increase the slidability between the inner peripheral surface of the pressurizing belt and the nip forming member, a lubricant is applied on the inner peripheral surface of the pressurizing belt. In addition, to maintain a state in which an appropriate amount of lubricant is present on the inner peripheral surface of the pressurizing belt for a longer period, a lubricant application member that applies the lubricant on the inner peripheral surface of the pressurizing belt is provided.

Meanwhile, a fixing apparatus which includes a fixing belt and pressurizing belt and in which a nip portion is formed by pressing the pressurizing belt against the fixing belt that is heated is known as disclosed in Japanese Patent Laid-Open No. 2015-59964. In this fixing apparatus, a detection portion for detecting the position of the fixing belt in the rotation axis direction of the fixing belt is provided. Control is performed in accordance with the detection result obtained by the detection portion such that the fixing belt reciprocates in a predetermined region in the width direction. The detection portion includes a moving member that is a swingable arm-shaped member, and a detection sensor that detects the displacement of the moving member. Further, the moving member is kept in contact with an end surface of the fixing belt by a pressure low enough to not affect the movement of the fixing belt in the width direction all the time, and thus the displacement of the moving member is detected by the detection sensor.

However, in the case where the detection portion described in Japanese Patent Laid-Open No. 2015-59964 is applied to the fixing apparatus described in Japanese Patent Laid-Open No. 2007-79036 mentioned above, the following problem can occur. That is, in the case where a lubricant is applied on the inner peripheral surface of the belt, there is a possibility that, as the traveling time of the belt accumulates, the lubricant on the inner peripheral surface of the belt moves to an end portion of the belt in the width direction and attaches to the arm member in contact with the end surface of the belt. If the lubricant attaches to the arm member, there is a risk that the lubricant leaks from the inner peripheral surface of the belt via the arm member.

In the case where a lubricant leaks from the inner peripheral surface of the belt, the lubricant spreads to the surroundings via the arm member, and there is a risk that members adjacent to the arm member are also contaminated by the lubricant and further the lubricant drops onto a recording material conveyed in a nip portion. If a plate for receiving this is additionally provided to prevent this, the number of parts increases. Therefore, it is preferable to use a simple configuration to suppress the leakage of the lubricant to the outside of the belt via the detection arm.

The present invention provides a configuration that suppresses leakage of a lubricant to the outside of a belt via a detection arm.

SUMMARY OF THE INVENTION

According to an aspect of the present invention, a fixing apparatus is configured to fix an image to a recording material, and includes a rotatable belt comprising an inner peripheral surface on which a lubricant is applied, a rotatable pressurizing member configured to form a nip portion to nip and convey the recording material between the pressurizing member and the belt, a steering roller configured to stretch the belt and incline to move the belt in a width direction intersecting with a rotation direction of the belt, a contact portion configured to come into contact with an end portion, in the width direction, of the belt, a detected portion, a position of the detected portion being changed on a basis of a position of the contact portion, a sensor configured to detect the position of the detected portion, an inclination of the steering roller being controlled on a basis of a detection result of the sensor, and a guiding portion provided by connecting with the contact portion, the lubricant being guided from the contact portion to the guiding portion. The guiding portion is provided in a region below the contact portion in a vertical direction, inside of the belt, and overlapped with the belt in the width direction.

Further features of the present invention will become apparent from the following description of exemplary embodiments with reference to the attached drawings.

DESCRIPTION OF THE EMBODIMENTS

An embodiment of the present invention will be described in detail below with reference to FIGS. 1 to 7. In the present embodiment, a tandem-type full-color printer will be described as an example of an image forming apparatus 1. To be noted, the present invention is not limited to the image forming apparatus 1 of a tandem type, and may be applied to an image forming apparatus of a different type. In addition, the image forming apparatus is not limited to a full-color printer, and may be a monochromatic printer or a black-and-white printer.

Image Forming Apparatus

Figure 1:
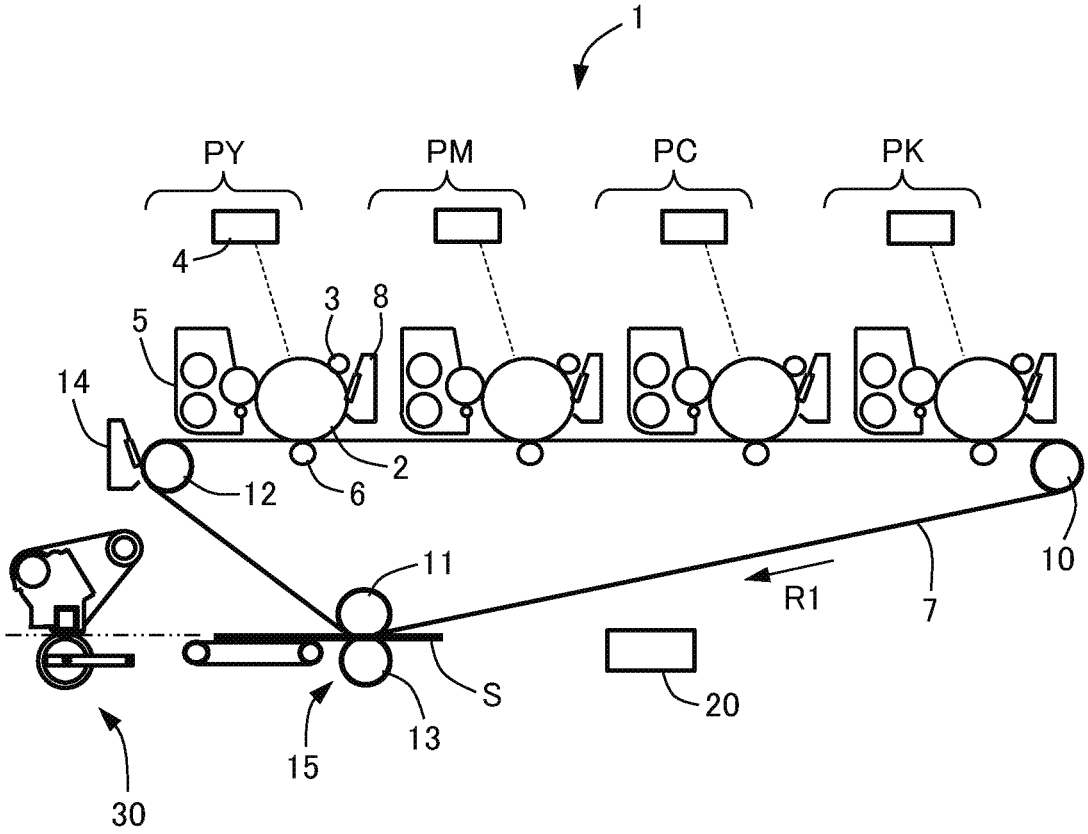
FIG. 1 is a section view of an image forming apparatus according to an embodiment illustrating a schematic configuration thereof.

As illustrated in FIG. 1, the image forming apparatus 1 is a full-color printer of an electrophotographic system including image forming portions PY, PM, PC, and PK respectively provided for four colors of yellow, magenta, cyan, and black in an apparatus body. In the present embodiment, an intermediate transfer tandem system in which the image forming portions PY, PM, PC, and PK are arranged along the rotation direction of an intermediate transfer belt 7 is employed. The image forming apparatus 1 forms a toner image serving as an image on a recording material S in accordance with an image signal received from an unillustrated document reading apparatus connected to the apparatus body or a host device such as a personal computer communicably connected to the apparatus body. Examples of the recording material S include sheet materials such as paper sheets, plastic films, and cloths. In addition, the image forming apparatus 1 includes a controller 20 for performing various control such as an image forming process.

The image forming process will be described. First, the image forming portions PY, PM, PC, and PK will be described. In the present embodiment, the image forming portions PY, PM, PC, and PK are configured in substantially the same manner except that the colors of toner therein, which are respectively yellow, magenta, cyan, and black, are different. Therefore, in the description below, the image forming portion PY for yellow will be described as a representative example, and description of the other image forming portions PM, PC, and PK will be omitted.

The image forming portion PY is mainly constituted by a photosensitive drum 2, a charging unit 3, an exposing unit 4, a developing unit 5, and so forth. The surface of the photosensitive drum 2 serving as an example of an image bearing member that is rotationally driven is uniformly charged by the charging unit 3 in advance, and then an electrostatic latent image is formed thereon by the exposing unit 4 driven on the basis of a signal of image information. That is, an electrostatic latent image is formed on the photosensitive drum 2. The electrostatic latent image formed on the photosensitive drum 2 is developed with toner by the developing unit 5, and is thus visualized as a toner image. In addition, toner in the developer consumed in image formation is replenished from an unillustrated toner cartridge together with carrier.

Then, a predetermined pressurizing force and a primary transfer bias is applied by a primary transfer roller 6 that is disposed to oppose the photosensitive drum 2 with the intermediate transfer belt 7 therebetween, and the toner image formed on the photosensitive drum 2 is transferred onto the intermediate transfer belt 7 through primary transfer. Transfer residual toner remaining on the photosensitive drum 2 in a small amount after the primary transfer is removed by a cleaning unit 8 to prepare for the next image forming process.

The intermediate transfer belt 7 is stretched by a tension roller 10, a secondary transfer inner roller 11, and a driving roller 12. The intermediate transfer belt 7 is driven by a driving roller 12 to move in a rotation direction R1. Image forming processes of respective colors performed by the image forming portions PY, PM, PC, and PK described above are performed at such timings that toner images are transferred onto the intermediate transfer belt 7 through primary transfer in such a manner that more downstream toner images are sequentially superimposed on more upstream toner images in the movement direction. As a result of this, eventually a full-color toner image is formed on the intermediate transfer belt 7, and is conveyed to a secondary transfer portion 15. The secondary transfer portion 15 is a transfer nip portion formed by a secondary transfer outer roller 13 and a part of the intermediate transfer belt 7 stretched by the secondary transfer inner roller 11. To be noted, transfer residual toner remaining after the toner image passes through the secondary transfer portion 15 is removed from the intermediate transfer belt 7 by a transfer cleaner unit 14.

A conveyance process of a recording material S to the secondary transfer portion 15 is performed at a timing corresponding to the formation process of the toner image conveyed to the secondary transfer portion 15. In the conveyance process, the recording material S is fed from an unillustrated sheet cassette or the like, and is conveyed to the secondary transfer portion 15 at a timing matching the image formation timing. In the secondary transfer portion 15, a secondary transfer voltage is applied to the secondary transfer inner roller 11.

In this manner, the toner image is transferred in the secondary transfer portion 15 from the intermediate transfer belt 7 to the recording material S through secondary transfer by the image forming process and the conveyance process. Then, the recording material S is conveyed to a fixing apparatus 30, and the toner image is heated and pressurized by the fixing apparatus 30 to melt and adhere to the recording material S. That is, the fixing apparatus 30 fixes the unfixed toner image formed by the image forming portions to the recording material S. The recording material S to which the toner image has been fixed in this manner is discharged onto an unillustrated discharge tray by a discharge roller.

Controller

The image forming apparatus 1 includes a controller 20 for performing various control such as the image forming operation described above. The operation of each portion of the image forming apparatus 1 is controlled by the controller 20 provided in the image forming apparatus 1. The series of image forming operation is controlled by the controller 20 in accordance with each input signal input through an operation portion provided on an upper surface of the apparatus body or input through a network.

Figure 2:
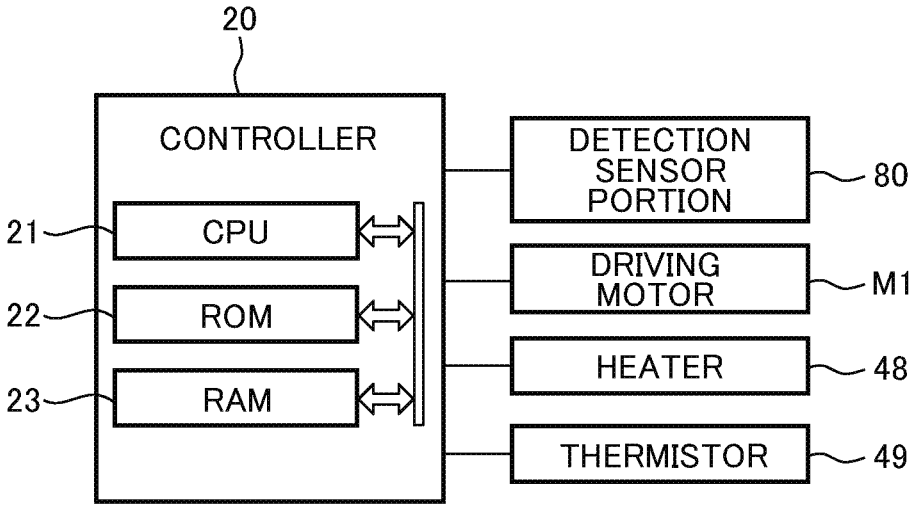
FIG. 2 is a control block diagram of the image forming apparatus according to the embodiment.

As illustrated in FIG. 2, the controller 20 includes a central processing unit: CPU 21 serving as a calculation controller, a read-only memory: ROM 22, a random access memory: RAM 23, and so forth. The CPU 21 controls each portion of the image forming apparatus 1 while reading a program corresponding to a control procedure stored in the ROM 22. The RAM 23 stores work data, input data, and so forth, and the CPU 21 performs control on the basis of the program and the like described above and with reference to data stored in the RAM 203, The controller 20 is connected to a detection sensor portion 80 of a detection portion 54 of the fixing apparatus 30 that will be described later, a driving motor M1 for driving a fixing belt 41, a heater 48 and a thermistor 49 that will be described later, and is thus capable of controlling the fixing apparatus 30.

Fixing Apparatus

Figure 3:
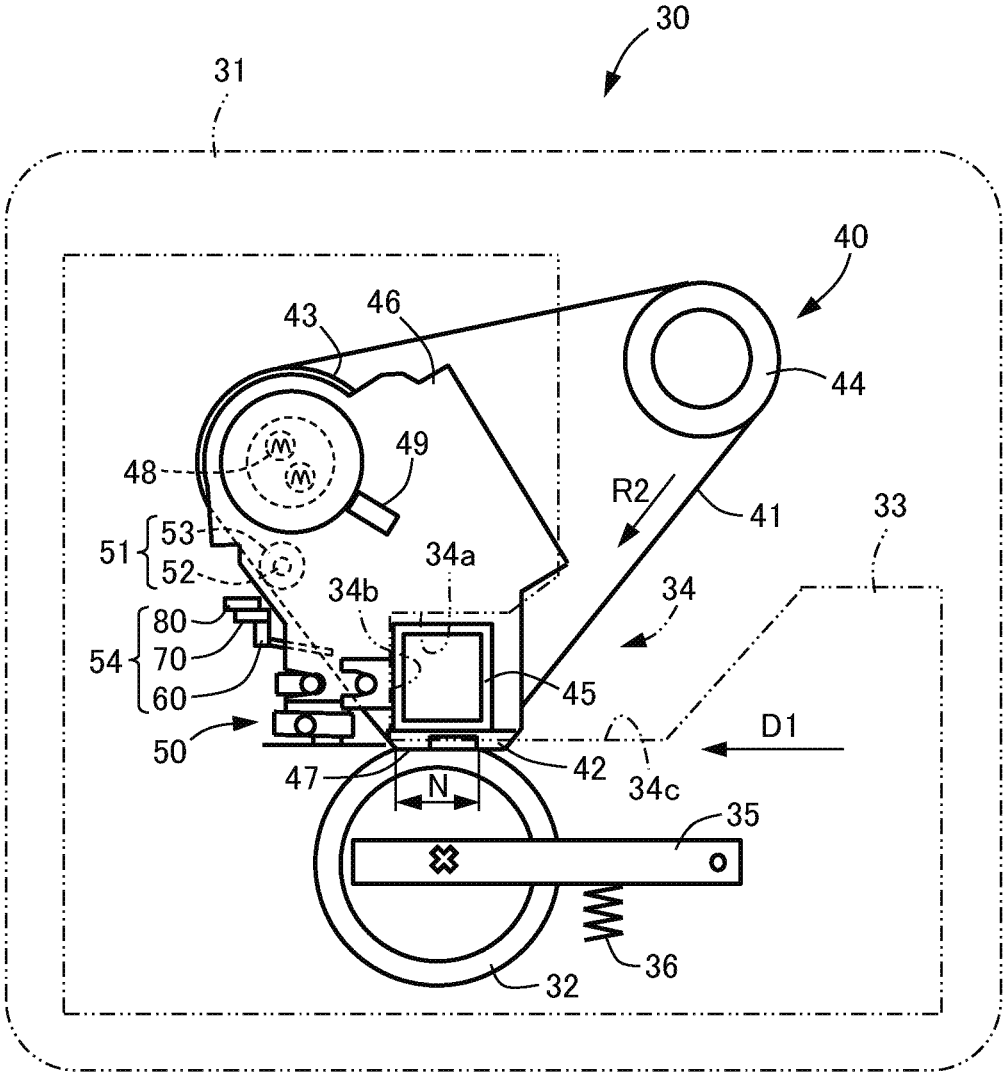
FIG. 3 is a section view of a fixing apparatus according to the embodiment.

Next, the fixing apparatus 30 will be described in detail with reference to FIG. 3. As illustrated in FIG. 3, the fixing apparatus 30 is a heating apparatus of a belt heating system, and is formed as a cartridge attachable to and detachable from the apparatus body of the image forming apparatus 1 illustrated in FIG. 1. The fixing apparatus 30 includes a casing 31, a heating unit 40, a pressurizing roller 32 serving as a rotary member, and a separation unit 50.

The heating unit 40 includes a fixing belt 41 that is a belt having an endless shape and rotatable in a rotation direction R2, a pressurizing pad 42 serving as a pad member that is a nip forming member, a heating roller 43, a steering roller 44, and a stay 45. The heating unit 40 is a cartridge in which the constituent elements described above are integrated by unit side plates 46, and is detachably attached to the casing 31. The unit side plates 46 are provided at respective side portions of the heating unit 40 in the rotation axis direction.

The fixing belt 41 is a thin cylindrical belt member that is capable of corning into contact with the recording material S to heat the recording material S and has thermal conductivity and heat resistance. In the present embodiment, the fixing belt 41 has a three-layer structure including a base layer an elastic layer on the outer peripheral surface of the base layer, and a releasing layer on the outer peripheral surface of the elastic layer. The base layer has a thickness of 60 μm and is formed from a polyimide resin: PI resin, and the elastic layer has a thickness of 300 μm and is formed from a silicone rubber. The releasing layer has a thickness of 30 μm and is formed from ethylene tetrafluoride-perfluoroalkoxy ethylene copolymer: PFA serving as a fluorine resin. The fixing belt 41 is stretched by the pressurizing pad 42, the heating roller 43 serving as an example of a stretching roller, and the steering roller 44. In the present embodiment, the outer diameter of the fixing belt 41 is, for example, 120 mm, and the rotation speed of the fixing belt 41 is, for example, 300 mm/s.

The pressurizing pad 42 is supported by the stay 45, and is pressed against the pressurizing roller 32 with the fixing belt 41 therebetween. The stay 45 is formed from stainless steel, and both end portions thereof in the rotation axis direction are supported by fixing frames 33 of the casing 31 of the fixing apparatus 30. A fixing nip portion N serving as an example of a nip portion is formed in a contact portion between the fixing belt 41 and the pressurizing roller 32. That is, the pressurizing pad 42 is disposed to oppose the pressurizing roller 32 with the fixing belt 41 therebetween, and forms the fixing nip portion N between the fixing belt 41 and the pressurizing roller 32. To be noted, the rotation axis direction is a sub-scanning direction perpendicular to a conveyance direction of the recording material S having passed through the fixing nip portion N.

The pressurizing pad 42 is formed from, for example, a liquid crystal polymer resin: LCP resin. A lubrication sheet 47 is placed between the pressurizing pad 42 and the fixing belt 41. As the lubrication sheet 47, for example, a PI sheet coated with polytetrafluoroethylene: PTFE and having a thickness of 100 μm is used. Protrusions having a height of 100 μm are formed on the PI sheet at intervals of 1 min, and thus the contact area between the PI sheet and the fixing belt 41 is reduced to reduce the sliding drag, A lubricant is applied on the inner peripheral surface of the fixing belt 41 such that the fixing belt 41 smoothly slides on the pressurizing pad 42.

An unillustrated lubricant for increasing the slidability is applied on the side of the lubrication sheet 47 that comes into contact with the fixing belt 41. In the present embodiment, oil is used as the lubricant. Silicone oil is preferably used as the oil from the viewpoint of heat resistance, and various viscosities can be selected in accordance with the use conditions. However, since the fluidity for application is low if the viscosity is too high, normally a viscosity equal to or lower than 30000 cSt is selected. Specific examples of the oil include, but are not limited to, dimethyl silicone oil, amino-modified silicone oil, and fluorine-modified silicone oil.

The heating roller 43 is a pipe having a thickness of 1 mm and formed from stainless steel, and the heater 48 serving as a heating portion that is constituted by, for example, a halogen heater, is provided inside the heating roller 43, and thus the heating roller 43 can be heated to a predetermined temperature, for example, 180° C. The fixing belt 41 is heated by the heating roller 43, and is maintained at a predetermined target temperature corresponding to the sheet type, on the basis of a temperature detected by the thermistor 49. The thermistor 49 is provided in contact with the heating roller 43. In addition, an unillustrated gear is fixed to one end portion of the heating roller 43 in the rotation axis direction, and the heating roller 43 is connected to the driving motor M1 illustrated in FIG. 2 via the gear to be rotationally driven. The fixing belt 41 is rotated by the rotation of the heating roller 43. Although a case where the heater 48 is capable of heating the fixing belt 41 is described in the present embodiment, the configuration is not limited to this, and alternatively one or more of the fixing belt 41 and the pressurizing roller 32 may be also heated.

The steering roller 44 is a tension roller that is urged by an unillustrated spring supported by a frame of the heating unit 40 and applies a predetermined tension to the fixing belt 41, and is pivoted by the rotation of the fixing belt 41. The tension generated by the urging spring is, for example, 50N, and the fixing belt 41 is caused to follow the pressurizing pad 42 by applying the tension to the fixing belt 41. The steering roller 44 is a stainless steel pipe having an outer diameter of 41 mm and a thickness of 1 mm, and end portions thereof are rotatably supported by unillustrated bearings.

Figure 4:
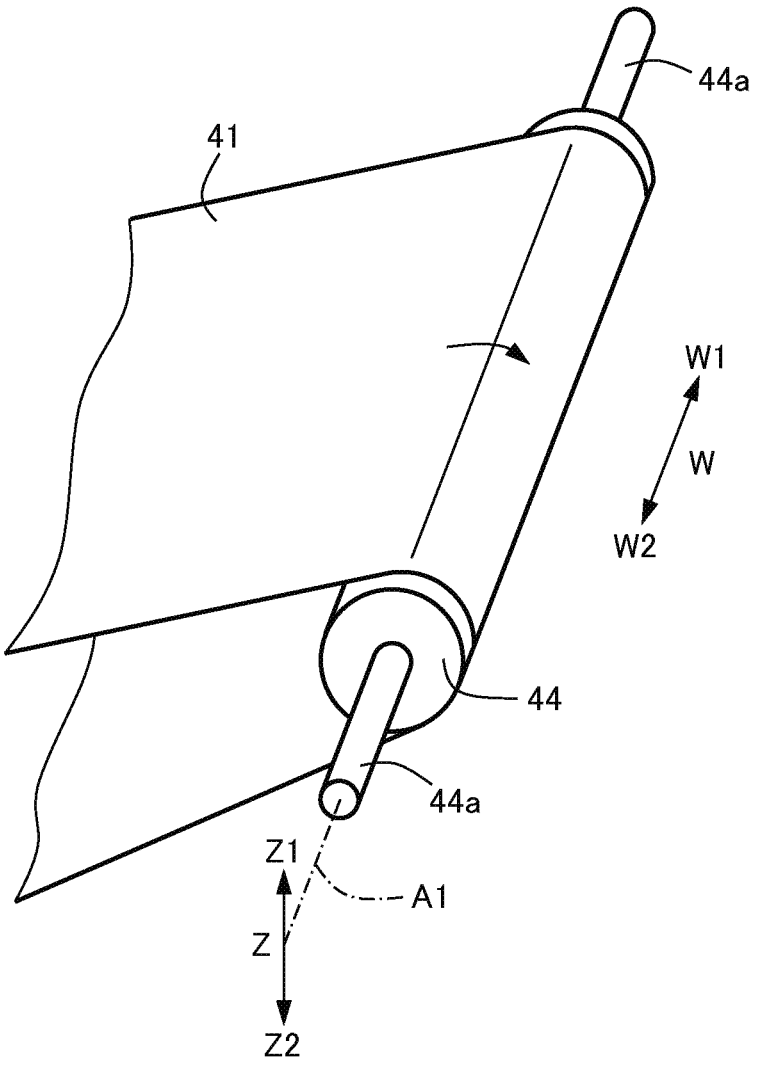
FIG. 4 is a perspective view of a steering roller of the fixing apparatus according to the embodiment.

As illustrated in FIG. 4, the steering roller 44 is configured such that the orientation of a rotation axis A1 of the steering roller 44 can be changed with respect to the rotation axis of the heating roller 43 illustrated in FIG. 3. An end portion shaft 44*a* projecting to both sides in the rotation axis direction from end portions of the steering roller 44 is configured to be swung in a direction Z by unillustrated steering arms. As a result of this, the orientation and angle of the steering roller 44 can be changed in the direction 7 with a center portion in a width direction W of the fixing belt 41 as a pivot center. The angle change width at this time is, for example, about ±2°.

As a result of the change of the orientation and angle of the steering roller 44, tension difference is generated in the width direction W in the fixing belt 41 stretched by the steering roller 44, and thus the fixing belt 41 moves in the width direction W That is, the steering roller 44 is capable of tilting with respect to the rotation axis direction of the heating roller 43 to move the fixing belt 41 in the width direction W to adjust the position of the fixing belt 41. In the case where the orientation of the steering roller 44 is changed in a direction Z1, the fixing belt 41 moves in a direction W2. In the case where the orientation of the steering roller 44 is changed in a direction Z2, the fixing belt 41 moves in a direction W1. This is repeated to reciprocate the fixing belt 41 in the width direction W in a predetermined region, To be noted, the steering arms that swing the end portion shaft 44*a* are operated by receiving a driving force from an unillustrated drive source. This drive source is controlled by using a detection result obtained by a detection portion 54 that detects the position of the fixing belt 41 in the width direction W as will be described later.

As illustrated in FIG. 3, the pressurizing roller 32 opposes and abuts the fixing belt 41 to form the fixing nip portion N that is pressurized between the fixing belt 41 and the pressurizing roller 32. The pressurizing roller 32 is a roller having an elastic layer on the outer peripheral surface of a shaft and a releasing layer on the outer peripheral surface of the elastic layer. This pressurizing roller 32 includes a shaft formed from stainless steel, an elastic layer having a thickness of 5 mm and formed from an electrically conductive silicone rubber, and a releasing layer having a thickness of 50 μm and formed from PEA serving as a fluorine resin. The pressurizing roller 32 is rotatably supported by the fixing frames 33 of the casing 31 of the fixing apparatus 30. A gear is fixed to an end portion of the pressurizing roller 32 in the rotation axis direction, and the pressurizing roller 32 is connected to the driving motor M1 illustrated in FIG. 2 via the gear to be rotationally driven.

In the fixing nip portion N formed between the fixing belt 41 and the pressurizing roller 32, the recording material S illustrated in FIG. 1 bearing a toner image is nipped and conveyed, and the toner image is heated. In this manner, the fixing apparatus 30 fixes the toner image to the recording material S While nipping and conveying the recording material S. Therefore, a function of applying heat and pressure and a function of conveying the recording material S need to be exerted simultaneously.

The fixing frames 33 are fixed to respective side portions of the casing 31 in the rotation axis direction, and each include a guide portion 34, a pressurizing frame 35, and a pressurizing spring 36. The stay 45 of the heating unit 40 is inserted in the guide portions 34, and is fixed by being pressed against the guide portions 34 by an unillustrated pressing portion. After the stay 45 is fixed to the guide portions 34, the pressurizing frames 35 are moved toward the heating unit 40 by an unillustrated drive source and cams, and thus the pressurizing roller 32 is pressed against the pressurizing pad 42 with the fixing belt 41 therebetween. The pressurizing force of the pressurizing roller 32 on the pressurizing pad 42 in image formation is, for example, 1000 N. To be noted, the fixing frames 33 swingably support the separation unit 50 that separates the recording material S having passed through the fixing nip portion N from the fixing belt 41.

The guide portion 34 includes a supporting surface 34*a*, a positioning surface 34*b*, and a sliding surface 34*c*. The supporting surface 34*a* is formed on an opposite side to the pressurizing roller 32 along an attachment direction D1 in which the heating unit 40 is inserted, and in the case where the heating unit 40 is in an attached position illustrated in FIG. 3, a reaction force that the fixing belt 41 receives from the pressurizing roller 32 is supported by the supporting surface 34*a* on the inner peripheral side of the fixing belt 41. The positioning surface 34*b* is thrilled approximately vertically in the most rear portion of the guide portion 34 in the attachment direction D1, and in the case where the heating unit 40 is in the attached position, the positioning surface 34*b* abuts and positions the healing unit 40 in the attachment direction D1. The sliding surface 34*c* is formed along the attachment direction D1 to oppose the supporting surface 34*a*, and slides on the stay 45 to guide the heating unit 40 when inserting or pulling out the heating unit 40. The heating unit 40 can be moved to the attached position by inserting the stay 45 in the guide portions 34, and the heating unit 40 can be detached from the casing 31 by pulling the stay 45 out of the guide portions 34.

Application Member

The heating unit 40 includes an application member 51 serving as an example of a lubricant application portion that applies a lubricant on the inner peripheral surface of the fixing belt 4F The application member 51 is disposed between the pressurizing pad 42 and the heating roller 43, and is in contact with the inner peripheral surface of the fixing belt 41. The application member 51 is in contact with the inner peripheral surface of the fixing belt 41 while being urged toward the inner peripheral surface of the fixing belt 41 by an unillustrated urging member. To be noted, although a case where a rotary member is used as the application member 51 has been described in the present embodiment, the configuration is not limited to this, and the application member 51 may be a non-rotary member. In addition, although a case where the application member 51 is urged toward the inner peripheral surface of the fixing belt 41 by an unillustrated urging member has been described in the present embodiment, the configuration is not limited to this, and the application member 51 may be fixed to such a position as to abut the inner peripheral surface of the fixing belt 41.

The application member 51 includes a shaft portion 52 rotatably supported by the unit side plates 46, and a lubricant holding layer 53 provided on the outer peripheral surface of the shaft portion 52. Examples of the material constituting the shaft portion 52 include aluminum, iron, stainless steel, and brass. The lubricant holding layer 53 is a layer that is impregnated with the lubricant to be applied and thus holds the lubricant, and the lubricant impregnating this layer oozes out to be applied on the inner peripheral surface of the fixing belt 41. Examples of the material of the lubricant holding layer 53 include porous materials and fiber materials. The amount of lubricant impregnating the lubricant holding layer 53 is, for example, 3.6 g in the present embodiment.

Detection Portion

A detection portion 54 that detects the movement of the fixing belt 41 in the width direction \V is provided between the application member 51 and the pressurizing pad 42 in the rotation direction R2 of the fixing belt 41. The detection portion 54 includes a detection arm 60 serving as an arm portion that is an example of a moving member, a flag member 70 serving as a detected portion, and the detection sensor portion 80 serving as an example of a detector. Although the flag member 70 is formed as a member separate from the detection arm 60 in the present embodiment, these two members may be integrated. In the present embodiment, the detection portion 54 is provided on only one side of the fixing belt 41 in the width direction W However, the detection portion 54 may be provided on each side of the fixing belt 41. The detection arm 60 is preferably formed from a metal material to suppress wear caused by being rubbed by the fixing belt 41. The entirety of the detection arm 60 may be formed from the metal material, or alternatively, a configuration in which only a portion of the detection arm 60 that comes into contact with the fixing belt 41 is formed from the metal material may be employed. Further, a configuration in Which only a distal end portion of the detection arm 60 that comes into contact with the fixing belt 41 is formed from the metal material as a metal member, and the detection arm 60 is formed by fixing the metal member to a resin member may be employed.

Figure 5:
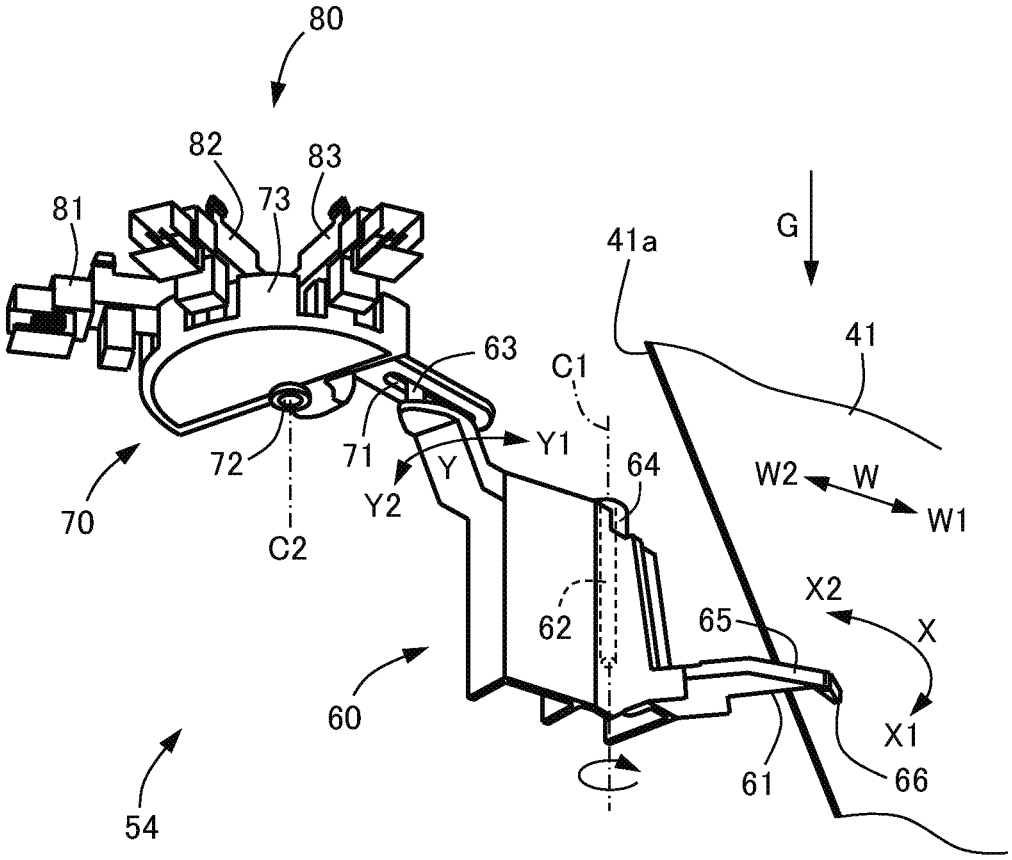
FIG. 5 is a perspective view of a detection portion of the fixing apparatus according to the embodiment.
Figure 6:
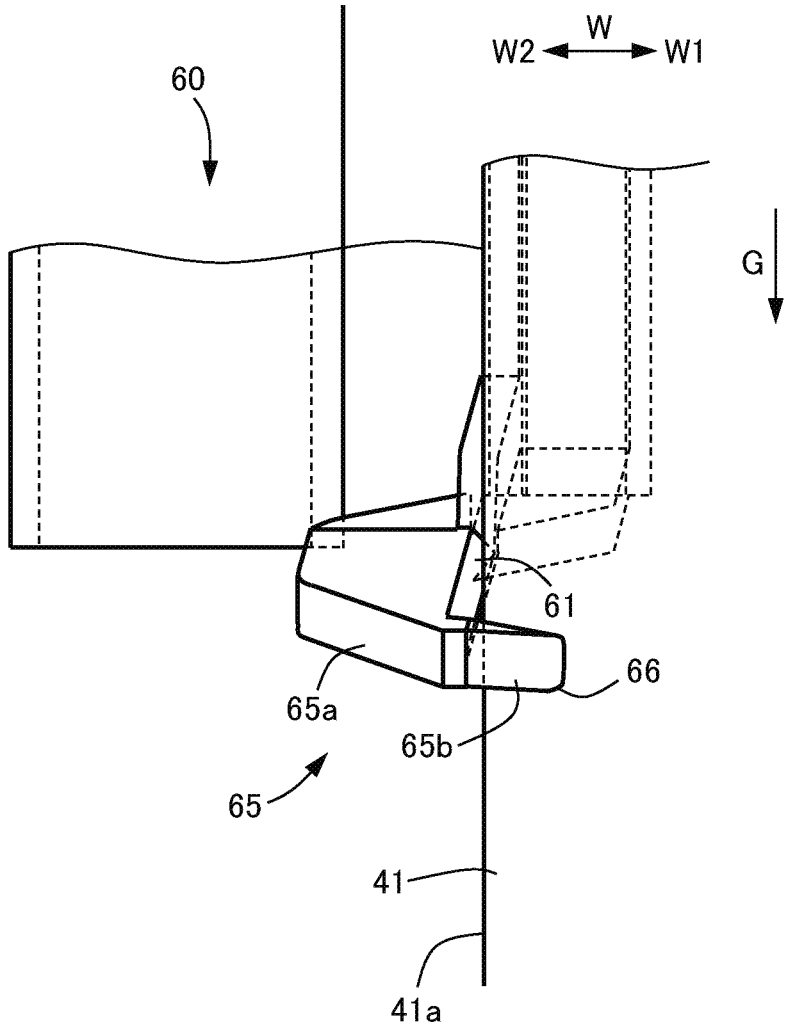
FIG. 6 is a front view of an arm of the detection portion of the fixing apparatus according to the embodiment.
Figure 7:
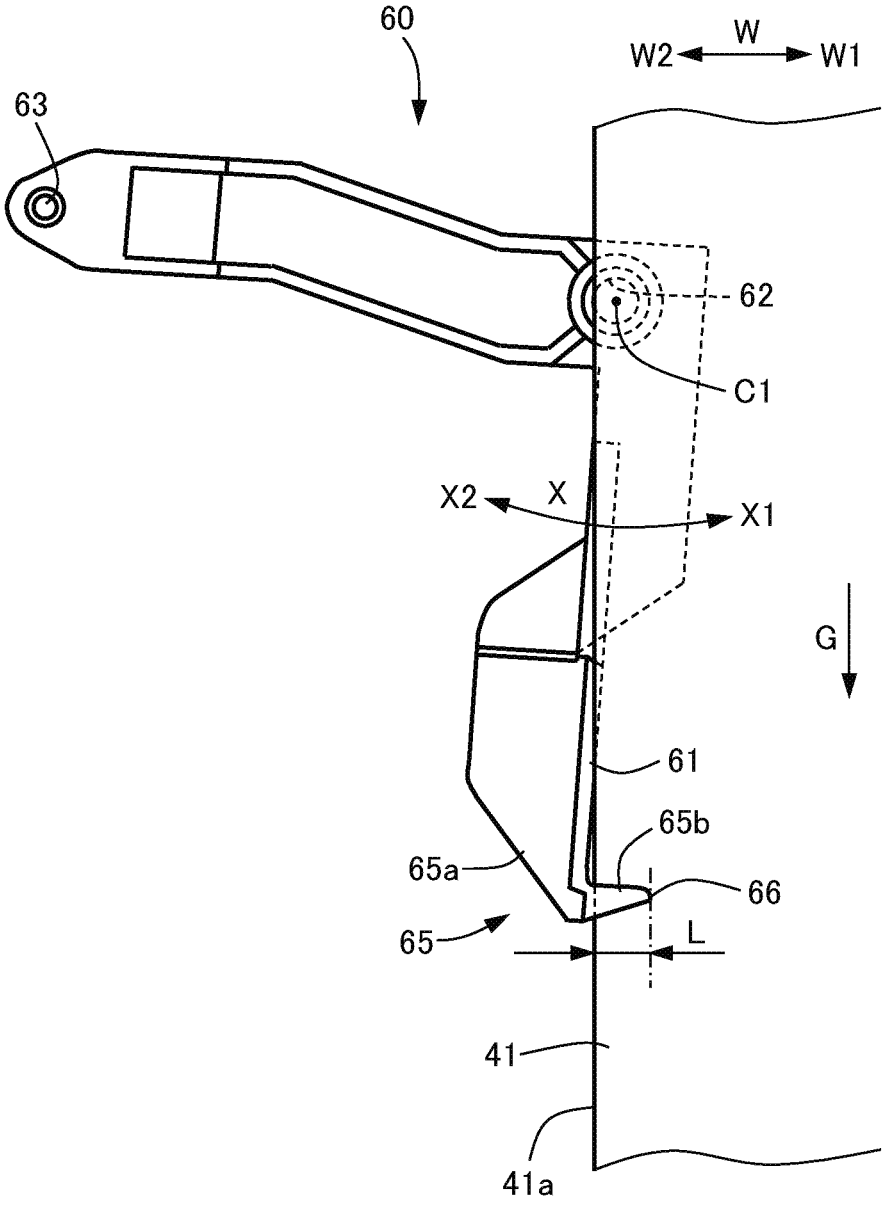
FIG. 7 is a plan view of the arm of the detection portion of the fixing apparatus according to the embodiment.

As illustrated in FIGS. 5 to 7, the detection arm 60 comes into contact with an end surface 41*a* of the fixing belt 41 in the width direction W of the fixing belt 41 by a low pressure, and moves in accordance with the movement of the fixing belt 41 in the width direction W That is, the detection arm 60 swings in accordance with the position of the fixing belt 41 in the width direction W. In the present embodiment, the detection arm 60 is provided upstream of the application member 51 and downstream of the pressurizing pad 42 in the rotation direction R2 of the fixing belt 41 as illustrated in FIG. 3. To be noted, the installation position of the detection arm 60 is not limited to this, and may be a different position as long as the detection arm 60 comes into contact with the end surface 41*a* of the fixing belt 41.

FIG. 5 is a schematic perspective view of a portion where the detection arm 60 is in contact with the end surface 41*a* of the fixing belt 41. The detection arm 60 includes a contact portion 61 that comes into contact with the end surface 41*a* of the fixing belt 41, a swing hole 62, and an engagement pin 63. The detection arm 60 is supported by the heating unit 40 so as to be swingable about a swing axis C1 in a state in which an unillustrated shaft member is fitted in the swing hole 62 as illustrated in FIG. 7. In the present embodiment, the detection arm 60 is swingably provided with the up-down direction as a swing axis direction.

In addition, the heating unit 40 includes an urging spring 64 serving as an example of an urging portion that urges the detection arm 60 toward the end surface 4 la of the fixing belt 41. The detection arm 60 is urged by the urging spring 64 so as to swing in a direction XL As a result of the urging force from the urging spring 64, the contact portion 61 provided in the detection arm 60 is in contact with the end surface 41*a* of the fixing belt 41 by a pressure low enough to not hinder the movement of the fixing belt 41 in the width direction W. In the present embodiment, this pressure is about 1 gf. As a result of being urged by the urging spring 64, the contact portion 61 can maintain the state of being in contact with the end surface 41*a* of the fixing belt 41, and thus follow the movement of the fixing belt 41 in the width direction W.

The flag member 70 includes an engagement groove 71 that engages with the engagement pin 63 of the detection arm 60, a swing hole 72, and a light shielding portion 73. The flag member 70 is supported by the heating unit 40 so as to be swingable about a swing axis C2 in a state in which an unillustrated shaft member is fitted in the swing hole 72. In the present embodiment, the flag member 70 is swingably provided with the up-down direction as a swing axis direction. In addition, since the engagement pin 63 is engaged with the engagement groove 71, the flag member 70 swings in accordance with the swing of the detection arm 60.

The detection sensor portion 80 is provided in the vicinity of the light shielding portion 73, and includes a plurality of optical sensors 81, 82, and 83. Since the optical sensors 81, 82, and 83 are configured in a similar manner, in the description below, the optical sensor 81 will be described as a representative example, and description of the other optical sensors 82 and 83 will be omitted. The optical sensor 81 includes a light emitting portion and a light receiving portion, and light such as infrared light is emitted from the light emitting portion toward the light receiving portion. In the case where the light reaches the light receiving portion, the optical sensor 81 returns an ON signal, and in the case where the light is shielded and does not reach the light receiving portion, the optical sensor 81 returns an OFF signal. The light shielding portion 73 of the flag member 70 is positioned so as to selectively shield or pass the infrared light from the optical sensor 81, 82, and 83 such that the signal returned from each optical sensor 81, 82, and 83 also changes between the ON signal and the OFF signal when the orientation and angle of the flag member 70 are changed and the light shielding portion 73 is moved. The orientation of the flag member 70 and thus the orientation and movement of the detection arm 60 can be detected on the basis of the combination of the signals. To be noted, although a case where the detection am 60 and the flag member 70 are separate members has been described in the present embodiment, the configuration is not limited to this, and these members may be integrated. In addition, although a case where the three optical sensors 81, 82, and 83 are provided as the detection sensor portion 80 has been described in the present embodiment, the configuration is not limited to this, and the number of the optical sensors may be different from three.

Projection Portion

Next, the configuration of a projection portion 65 of the detection arm 60 serving as a guiding portion and prevention of leakage of the lubricant applied on the inner peripheral surface of the fixing belt 41 via the detection arm 60 will be described with reference to FIGS. 5 to 7. As illustrated in FIG. 5, the projection portion 65 is formed on the detection arm 60. The projection portion 65 is an extending portion formed continuously from the contact portion 61 and provided to extend on the inner peripheral side of the fixing belt 41. As illustrated in FIGS. 6 and 7, the projection portion 65 includes a distal end portion 66 positioned further on the fixing belt 41 side in the width direction W than the contact portion 61 and below the contact portion 61 in a gravity direction G. That is, the distal end portion 66 projects further toward the center in the width direction W than the end surface 41*a* of the fixing belt 41. The distal end portion 66 is the lowest part of the projection portion 65. As described above, it is preferable that the lowest point of the projection portion 65 opposes the inner peripheral surface of the fixing belt 41.

In the present embodiment, the projection portion 65 includes a first inclined portion 65*a* and a second inclined portion 65*b*. The first inclined portion 65*a* is continuous with the contact portion 61 and has a shape inclined downward in a direction intersecting with the width direction W. The second inclined portion 65*b* is continuous with a lower end portion of the first inclined portion 65*a* and has a shape inclined downward toward the inner peripheral surface of the fixing belt 41, and the distal end portion 66 is formed at the distal end thereof. To be noted, although the shape of the projection portion 65 is not limited to this, the projection portion 65 is formed in such a shape that the projection portion 65 is continuous with the contact portion 61 and inclined downward in the entire region from the contact portion 61 to the distal end portion 66, and the distal end portion 66 is included in a space enclosed by the inner peripheral surface of the fixing belt 41. That is, the projection portion 65 is configured to guide the lubricant from the contact portion 61 to a region below the contact portion in the vertical direction, the region opposing the inner peripheral surface of the fixing belt 41. The projection portion 65 has a tapered sectional shape in which a distal end side thereof is narrower. The region includes a lowest point of the detection portion 54 in the vertical direction. The projection portion 65 is provided by connecting with the contact portion 61. The projection portion 65 is provided in a region below the contact portion 61 in the vertical direction, inside of the fixing belt 41, and overlapped with the fixing belt 41 in the width direction when viewed in a direction perpendicular to the rotation axis direction of the fixing belt 41.

When the fixing belt 41 is rotationally driven by the heating roller 43, after the fixing belt 41 travels for a while, an excess lubricant on the inner peripheral surface of the fixing belt 41 reaches the end surface 41*a*, and attaches to the contact portion 61 of the detection arm 60 in contact with the end surface 41*a*. The attached lubricant flows downward in the gravity direction G on the surface of the detection arm 60 while remaining in contact with the contact portion 61 due to the viscosity of the lubricant. Since the projection portion 65 is formed continuously from the contact portion 61 and positioned below the contact portion 61 in the gravity direction G, the lubricant attached to the detection arm 60 is guided downward along the first inclined portion 65*a* of the projection portion 65.

FIG. 6 is an enlarged view of the projection portion 65 of the detection arm 60 and the vicinity thereof. As illustrated in FIG. 6, the second inclined portion 65*b* of the projection portion 65 is not parallel to the width direction W or the horizontal direction, and is slightly inclined downward such that the distal end portion 66 side thereof is lower in the gravity direction G or the vertical direction. Therefore, the lubricant guided to the second inclined portion 65*b* of the projection portion 65 is further guided toward the distal end portion 66 of the projection portion 65 and reaches the distal end portion 66. Then, the lubricant has nowhere to flow to, and eventually drops due to the gravity. At this time, since the distal end portion 66 of the projection portion 65 is included in the space enclosed by the inner peripheral surface of the fixing belt 41, the dropped lubricant reattaches to the fixing belt 41. That is, the projection portion 65 has such a shape that the lubricant reached to the end surface 41*a* of the fixing belt 41 and attached to the contact portion 61 drops to the inner peripheral surface of the fixing belt 41 via the distal end portion 66.

The distal end portion 66 of the projection portion 65 needs to be positioned further on the center side in the width direction W than the end surface 41*a* of the fixing belt 41 in any orientation and angle of the detection arm 60. In addition, a distance L from the distal end portion 66 of the projection portion 65 to the end surface 41*a* of the fixing belt 41 in the width direction W illustrated in FIG. 7 decreases when the fixing belt 41 moves in the direction W2, that is, when the detection arm 60 swings in the direction X2. In response to this, in the present embodiment, the controller 20 controls the reciprocation of the fixing belt 41 such that the distance L is always 2 mm or larger while the fixing belt 41 is in a movement range in which an error does not occur.

As described above, in the fixing apparatus 30 of the present embodiment, the detection arm 60 includes the projection portion 65 continuous with the contact portion 61 and projecting toward the inner peripheral surface of the fixing belt 41. In addition, the projection portion 65 includes the distal end portion 66 positioned further on the fixing belt 41 side than the contact portion 61 in the width direction W and below the contact portion 61. Therefore, the lubricant reached to the end surface 41*a* of the fixing belt 41 and attached to the contact portion 61 drops to the inner peripheral surface of the fixing belt 41 from the distal end portion 66 via the projection portion 65. Therefore, the lubricant attached to the detection arm 60 is guided so as to reattach to the inner peripheral surface of the fixing belt 41 without flowing on parts other than the contact portion 61 and the projection portion 65, and thus leakage of the lubricant from the inner peripheral surface of the fixing belt 41 via the detection arm 60 can be suppressed.

Therefore, the risk of the lubricant spreading from the fixing belt 41, contaminating a member adjacent to the detection arm 60, and thus contaminating an image can be reduced. In addition, since the lubricant is supplied to the inner peripheral surface of the fixing belt 41 again, decrease of the total amount of the lubricant on the inner peripheral surface of the fixing belt 41 can be suppressed, good slidability of the inner peripheral surface of the fixing belt 41 can be maintained, and the lifetime of the fixing belt 41 can be improved.

To be noted, although a case where the fixing belt 41 serves as a belt and the pressurizing roller 32 serves as a rotary member in the fixing apparatus 30 has been described in the present embodiment described above, the configuration is not limited to this. For example, a pressurizing belt may serve as the belt and a fixing belt or a fixing roller may serve as the rotary member. In either case, the present invention can be applied to the belt.

In addition, although a case Where the detection arm 60 is provided so as to be swingable with the up-down direction as the swing axis direction in the fixing apparatus 30 has been described in the present embodiment described above, the configuration is not limited to this. For example, the detection arm 60 may be provided so as to be swingable with the horizontal direction or an inclined direction as the swing axis direction, and the swing axis direction can be appropriately set in accordance with the inclination angle of the fixing belt 41.

In addition, although a case where the pressurizing pad 42 is provided in the fixing apparatus 30 has been described in the present embodiment described above, the configuration is not limited to this, and the present invention can be applied to, for example, a roller instead of a pad.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-108333, filed Jun. 24, 2020 which is hereby incorporated by reference herein in its entirety.

What is claimed is:

1. A fixing apparatus configured to fix an image to a recording material, the fixing apparatus comprising:

a rotatable belt comprising an inner peripheral surface on which a lubricant is applied;

a rotatable pressurizing member configured to form a nip portion to nip and convey the recording material between the pressurizing member and the belt;

a steering roller configured to stretch the belt and incline to move the belt in a width direction intersecting with a rotation direction of the belt;

a lubricant application portion configured to come into contact with the inner peripheral surface of the belt to apply the lubricant on the inner peripheral surface of the belt;

a contact portion configured to come into contact with an end portion, in the width direction, of the belt;

a detection portion provided in connection with the contact portion, a position of the detection portion being changed on a basis of a position of the contact portion;

a sensor configured to detect the position of the detection portion, an inclination of the steering roller being controlled on a basis of a detection result of the sensor; and a guiding portion provided in connection with the contact portion, the lubricant being guided from the contact portion to the guiding portion, wherein the guiding portion is provided in a region below the contact portion in a vertical direction, inside of the belt, and overlapped with the belt in the width direction, and wherein the guiding portion is provided at a position not in connection with a member provided at an inside in a radius direction of the belt.

2. The fixing apparatus according to claim 1, wherein the detection portion comprises a swingable arm portion comprising the contact portion, and wherein the guiding portion comprises a first inclined portion and a second inclined portion, the first inclined portion being continuous with the contact portion and inclined downward in the vertical direction to guide the lubricant from the contact portion to the second inclined portion, the second inclined portion being continuous with a lower end portion of the first inclined portion and inclined downward in the vertical direction toward the inner peripheral surface of the belt to guide the lubricant from the first inclined portion to the region.

3. The fixing apparatus according to claim 2, further comprising an urging portion configured to urge the arm portion toward the end portion of the belt.

4. The fixing apparatus according to claim 1, wherein the region is positioned further on an inside of the belt than the end portion of the belt in the width direction by 2 mm or more while the fixing apparatus is operating.

5. The fixing apparatus according to claim 1, further comprising a pad member configured to stretch the belt and press the pressurizing member via the belt.

6. The fixing apparatus according to claim 1, wherein the detection portion is provided downstream of the nip portion and upstream of the lubricant application portion in the rotation direction of the belt.

7. The fixing apparatus according to claim 1, wherein the guiding portion has a tapered sectional shape in which a distal end side thereof is narrower.

8. The fixing apparatus according to claim 1, wherein the region includes a lowest point of the detection portion in the vertical direction.

9. The fixing apparatus according to claim 1, wherein the guiding portion, which is swung by steering operation, is provided at a position not in connection with the lubricant application portion.

* * * * *